US007374038B2

(12) United States Patent
Smalley

(10) Patent No.: US 7,374,038 B2
(45) Date of Patent: May 20, 2008

(54) CARTON WITH CONTAINER ACCESS OPENINGS WITH AT LEAST PARTIALLY REMOVABLE TABS

(75) Inventor: Brian Smalley, Bristol (GB)

(73) Assignee: Graphic Packaging International, Inc., Marietta, GA (US)

( * ) Notice: Subject to any disclaimer, the term of this patent is extended or adjusted under 35 U.S.C. 154(b) by 221 days.

(21) Appl. No.: 11/196,633

(22) Filed: Aug. 3, 2005

(65) Prior Publication Data

US 2007/0029212 A1 Feb. 8, 2007

(51) Int. Cl.
*B65D 75/00* (2006.01)
*B65D 65/00* (2006.01)

(52) U.S. Cl. ..... 206/175; 206/170; 206/174; 206/434

(58) Field of Classification Search ..... 206/140–143, 206/147, 162–175, 427, 434, 148–153
See application file for complete search history.

(56) References Cited

U.S. PATENT DOCUMENTS 2,281,592 A * 5/1942 O'Brien ..... 206/142
3,156,358 A * 11/1964 Randrup ..... 206/153
3,747,835 A 7/1973 Graser
3,767,042 A 10/1973 Ganz
3,780,906 A * 12/1973 Katzenmeyer ..... 206/170
3,963,121 A 6/1976 Kipp
4,256,226 A * 3/1981 Stone ..... 206/427
4,304,329 A * 12/1981 Graser ..... 206/148
4,424,901 A 1/1984 Lanier
4,708,284 A 11/1987 Sutherland et al.
4,875,585 A 10/1989 Kadleck et al.
4,925,019 A 5/1990 Ganz et al.
5,042,660 A 8/1991 Carver
5,297,673 A 3/1994 Sutherland
5,351,815 A 10/1994 Fogle et al.
5,400,901 A * 3/1995 Harrelson ..... 206/143
5,485,915 A 1/1996 Harris
5,549,197 A 8/1996 Sutherland
5,595,291 A * 1/1997 Negelen ..... 206/143
5,609,251 A 3/1997 Harris
5,941,389 A 8/1999 Gomes
5,975,287 A 11/1999 Negelen
6,378,697 B1 * 4/2002 Sutherland et al. ..... 206/140
6,814,228 B2 * 11/2004 Sutherland ..... 206/140
6,877,600 B2 4/2005 Sutherland
6,981,631 B2 1/2006 Fogle et al.
7,175,020 B2 2/2007 Sutherland et al.

(Continued)

FOREIGN PATENT DOCUMENTS

EP 0 094 806 A2 11/1983

(Continued)

*Primary Examiner*—Bryon P Gehman
(74) *Attorney, Agent, or Firm*—Womble Carlyle Sandridge & Rice, PLLC

(57) ABSTRACT

A carton for holding containers, such as beverage containers, is disclosed. The carton includes one or more openings in a top wall thereof for receiving necks of containers contained within the carton. One or more at least partially removable tabs are provided in the top wall, whereby the openings can be enlarged for individually removing the containers from the carton. The carton further includes flaps on a bottom panel thereof for retaining heels of the containers. A blank for forming the carton is also disclosed.

23 Claims, 5 Drawing Sheets

U.S. PATENT DOCUMENTS

| | | | |
|---|---|---|---|
| 2002/0112973 | A1 | 8/2002 | Sutherland |
| 2005/0001020 | A1 | 1/2005 | Garnier |

FOREIGN PATENT DOCUMENTS

| | | | |
|---|---|---|---|
| EP | 0 459 658 | A1 | 12/1991 |
| FR | 2 412 473 | | 7/1979 |
| WO | WO 94/02380 | | 2/1994 |

* cited by examiner

CARTON WITH CONTAINER ACCESS OPENINGS WITH AT LEAST PARTIALLY REMOVABLE TABS

BACKGROUND

Cartons that are used to contain multiple containers, such as beverage containers, often are constructed to be sufficiently durable to withstand shipping, stocking, and transportation to the purchaser's home. At the same time, such sturdy cartons may be difficult to open to access the containers therein. Thus, there is a continuing need for improved cartons that are sufficiently robust yet allow for ready access to the containers therein.

SUMMARY

The present invention is directed generally to a carton that may be used with, for example, cans and bottles of the types used to contain soft drinks, beer and the like. The carton includes various features that provide improved access to the containers therein.

BRIEF DESCRIPTION OF THE DRAWINGS

The description refers to the accompanying drawings in which like reference characters refer to like parts throughout the several views, and in which.

DETAILED DESCRIPTION

The present invention may be best understood by referring to the following figures. For purposes of simplicity, like numerals may be used to describe like features. However, it should be understood use of like numerals is not to be construed as an acknowledgement or admission that such features are equivalent in any manner. It also will be understood that where a plurality of similar features are depicted, not all of such identical features may be labeled on the figures.

Figure 1:
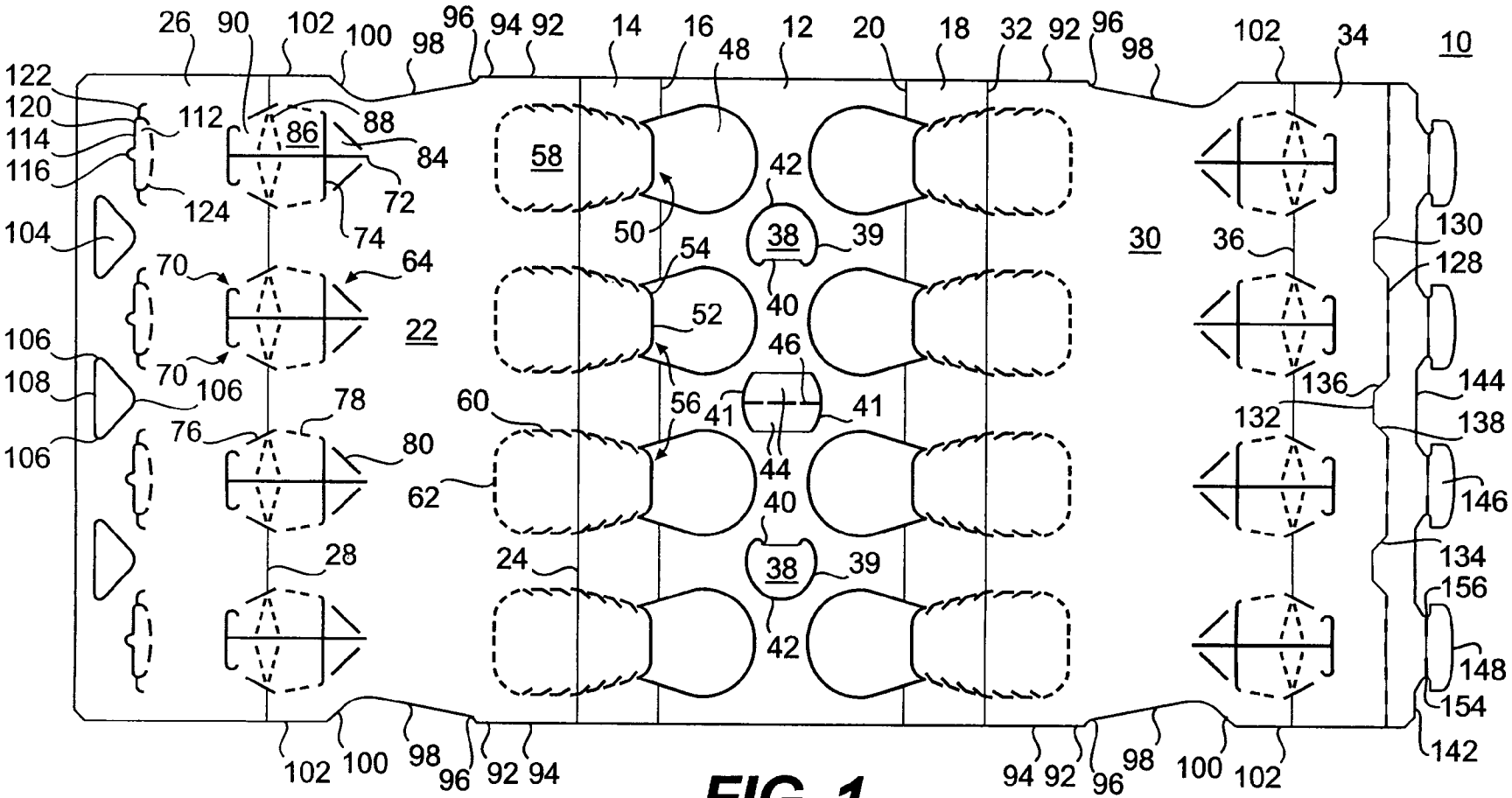
FIG. 1 is a plan view of an exemplary blank from which a carton may be formed, according to the present invention.

According to one aspect of the present invention depicted in FIG. 1, an exemplary blank 10 for forming a wrap-around carton is provided. The exemplary blank 10 can be folded into a carton that is capable of containing cans or bottles, for example, in two rows of four containers each, as will be discussed below. It will be understood by those of skill in the art that while particular exemplary blanks and cartons are shown and described herein, the various aspects of the present invention may be used with any carton or package, as needed or desired. Thus, numerous blanks and cartons are contemplated hereby.

Still viewing FIG. 1, the exemplary blank 10 includes a top panel 12 connected to a first angular panel 14 at fold line 16 and a second angular panel 18 at fold line 20. The first angular panel 14 is connected to a first side panel 22 at fold line 24. The first side panel 22 is connected to a first bottom panel section 26 at fold line 28. The second angular panel 18 is connected to a second side panel 30 at fold line 32. The second side panel 30 is connected to a second bottom panel section 34 at fold line 36.

The top panel 12 includes one or more opposed finger flaps 38 that may be pressed inward toward the interior of a carton formed from the blank 10 to serve as a gripping feature. The finger flaps 38 may have any suitable shape, for example, circular, rectangular, square, triangular, oval, or any other shape. In the exemplary blank 10 depicted in FIG. 1, the finger flaps 38 are defined by substantially circular slits 39 and a straight, recessed fold line 40. If desired, the finger flaps may be separably attached to the top panel 12 along one or more nicks 42, or other attachment points. A pair of opposed, separably joined thumb flaps 44 defined by arcuate slits 41 and substantially linear fold lines 43 may be located substantially equidistant from the finger flaps 38. The thumb flaps may be separably joined by one or more nicks 46 or other attachment points.

While particular combination of finger and thumb flaps are provided herein, it will be understood that any combination or configuration of such flaps may be used with the present invention. If desired, the flaps may be substituted by one or more apertures or openings. Additionally, it will be understood that other handle types and geometries are contemplated hereby. It further will be understood by those of skill in the art that more than one handle, opening, or finger or thumb flap may be provided, and that such one or more of such features may be provided in any of the various panels and on any of the sides of the resulting carton. Thus, while certain flap configurations are depicted and described herein, numerous configurations are contemplated hereby.

Figure 2:
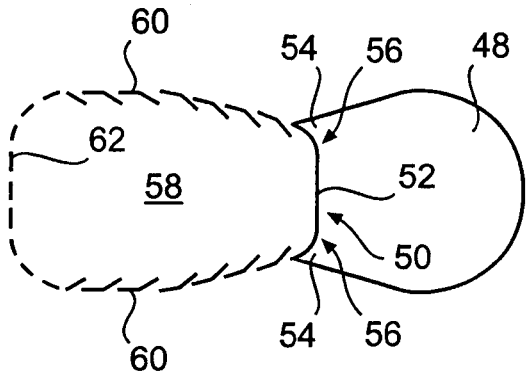
FIGS. 2-5 depict enlarged views of various aspects of the exemplary blank of FIG. 1.

The top panel 12 of the exemplary blank 10 of FIG. 1 includes a plurality of truncated teardrop shaped openings 48 extending into the first angular panel 14 and the second angular panel 18. As shown in FIG. 2, the truncated portion 50 of each opening 48 includes a linear segment 52 and a point 54 at each end 56 of the linear segment 52. In this example, the openings are configured in two rows, each having four openings. However, the configuration of such openings depends on the number of containers to be supported by the carton. Each opening is dimensioned to receive a neck of a bottle or other container, as will be discussed in greater detail below. Thus, the neck opening may have any suitable shape, for example, a circle, oval, square, rectangle, or any other shape capable of receiving the neck of the container. It will be understood that although such features are shown as being in the top panel, such features may be included in other panels, for example, a side panel, as desired.

Still viewing FIGS. 1 and 2, an optionally removable tab 58 extends from the truncated portion 50 of each opening 48 through the first angular panel 14 or second angular panel 18 onto the first side panel 22 or second side panel 30. The tab 58 may have any suitable shape and, in this example, the tab 58 is generally elongated in shape with curved "corners." In this example, tear lines 60 are zipper cuts to facilitate tearing, and tear line 62 is perforated. Where such a blank is used to form a carton, the tab may be separated partially or completely from the carton to form an enlarged opening to remove a container in the carton. However, other types of fold or tear lines may be used. Thus, for example, lines 60 may be tear lines and line 62 may be a fold line. Where such a blank is used to form a carton, the tab may be separated partially from the carton to form an enlarged opening, and optionally folded away from the carton to remove a container in the carton.

Figure 3:
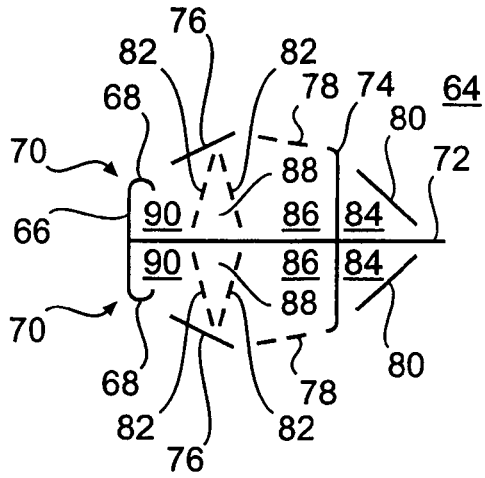

As illustrated in FIGS. 1 and 3, a heel receptacle 64 extends from the first side panel 22 and second side panel 30, and into the first bottom panel section 26 and second bottom panel section 34, respectively. The heel receptacle 64 may be used in a carton formed from the blank 10 to receive the heel or bottom portion of a bottle or other container. Various heel receptacles may be used with the present invention.

In the exemplary heel receptacle 64 depicted in FIGS. 1 and 3, a substantially linear slit 66 includes a J-cut 68 at each end 70 thereof. A lateral slit 72 extends substantially perpendicularly from about a midpoint of slit 66. A transverse slit 74 is substantially perpendicular to lateral slit 72. Angular slits 76 are spaced from and extend angularly away from each J-cut 68 in a direction toward the transverse slit 74. Angular perforations 78 extend between the angular slits 76 toward the transverse slit 74. Slits 80 extend between and are spaced from the angular perforation lines 78 and the lateral slit 72. A plurality of perforations form generally diamond-shaped fold lines or perforation pattern 82 extending between the angular slits 76 across the lateral slit 72 and substantially aligned with fold line 28 or 36. The various slits and perforated lines define a plurality of pairs of panels 84, 86, 88, and 90.

As stated above, when the blank 10 is formed into a carton and containers are placed therein, the heel receptacle is used to support the heel of a bottle or other container. In this example, to use the heel receptacle 64, panels 86, 88, and 90 are pivoted toward the interior carton along angular slits 76 and angular perforation lines 78. When the blank 10 is folded along fold line 28 or 36, the diamond shaped fold lines 88 allow panels 86 and 90 to fold toward one another. In doing so, flaps 88 and 90 become available to support the heel of a container, for example, a plastic bottle. Flaps 86 also become available to contact the surface of the bottle or container.

Returning to FIG. 1, the first side panel 22 and the second side panel 30 each include a pair of outer edges 92. Working from fold lines 24 and 32, each outer edge 92 includes a first, substantially linear portion 94 that terminates with jot 96. A second, tapered portion 98 extends angularly from jot 96 towards the adjacent heel receptacle 64. A third portion 100 extends from the second portion angularly away from the adjacent heel receptacle 64. A substantially linear fourth portion 102 extends from the third portion 100 and terminates at fold line 28 or 36. The fourth portion is substantially perpendicular to fold line 28 or 36. However, it will be understood that various edge patterns and configurations may be used with the present invention, and such patterns and configurations are contemplated hereby.

Still viewing FIG. 1, the first bottom panel section 26 and the second bottom panel section 34 include features that join the panel sections to form a bottom panel. For example, various locking features may be included. Alternatively, the panel sections may be joined using an adhesive or other fastening material. In the example shown in FIG. 1, the first bottom panel section 26 also includes a plurality of substantially triangular shaped openings 104. In this example, the first bottom panel section 26 includes three openings 104 that resemble isosceles triangles having rounded vertices 106. The base 108 of each opening 104 is substantially parallel to the terminal edge 110 of the first bottom panel section 26. Although a particular configuration is shown herein, other numbers and shapes of the openings may be used in accordance with the present invention as desired.

Figure 4:
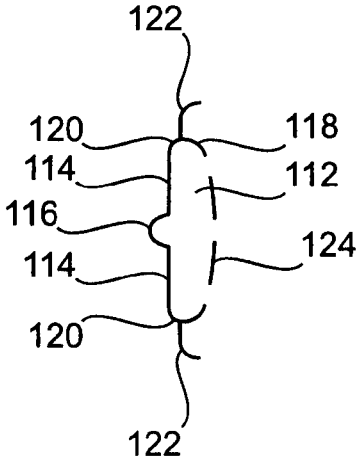
Figure 5:
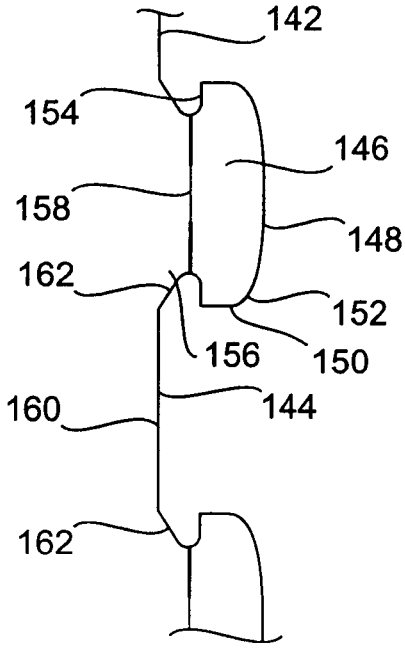

The first bottom panel section 26 further includes a plurality of elongated receiving flaps 112. In this example, the first bottom panel section 26 includes four receiving flaps 112 in a staggered configuration with the substantially triangular shaped openings 104. However, the number and shape of the receiving flaps may vary, depending on the particular application. As shown in FIGS. 1 and 4, each receiving flap 112 includes a substantially linear slit 114 having a protrusion 116 extending therefrom. Arcuate cuts 118 extend from the terminal points 120 of the substantially linear cut portion 114. J-cuts 122 extend away from the arcuate cuts 118. The elongated receiving flaps 112 further include a somewhat arcuate fold line 124, in this example, a perforated line, connected to the first bottom panel section 26. In this configuration, the receiving flaps 112 can be displaced partially from the first bottom panel section 26 and pivoted inward or outward along while remaining connected to thereto.

The second bottom panel section 34 further includes a plurality of cut crease segments 128 separated by substantially trapezoidal shaped flaps 130. In this example, the blank 10 includes four cut crease segments 128 and three flaps 130. It will be understood that the number of flaps may vary for a particular application. In one aspect, the number of flaps 130 may correspond to the number of substantially triangular shaped openings 104, and are spaced to be in alignment with the substantially triangular shaped openings 104 when a carton is formed from the blank 10.

Each flap 130 is defined by a score line having a first portion 132 substantially parallel to fold line 36 and a pair of angular portions 134 extending away from the ends 136 of the first portion 132. The angular portions 134 terminate in J-cuts 138 that abut creases 140 of the various cut crease segments 128. Although a particular flap and cut crease configuration is shown herein, it will be understood that other shapes and configurations are contemplated hereby.

The major edge 142 of the second bottom panel section 34 is defined by a plurality of alternating recessed segments 144 and protruding segments 146. The number of protruding segments 146 may generally correspond to the number of receiving flaps 112 in the first bottom panel section 26, and are spaced to be in alignment with the elongated receiving flaps 112 when a carton is formed from the blank 10. While a particular major edge configuration is shown herein, other configurations are contemplated hereby.

In this example, each protruding segment 146 includes a portion 148 that is substantially linear and substantially parallel to fold line 36. Each protruding segment 146 further includes edges 150 substantially perpendicular to fold line 36 and that adjoin the substantially linear portion 148 at curved corners 152. Another pair 154 of substantially linear segments that are substantially parallel to fold line 36 extends from edges 150 toward each other and terminates with a slight curvature to define neck 156. The neck 156 has a width that is less than the width of the protruding segment 146. The protruding segment 146 may be joined to the second bottom panel section 34 by a cut crease line 158. Each recessed segment 144 includes a substantially linear central portion 160 that is substantially parallel to fold line 36. Angular edges 162 extend therefrom towards neck 156 and meet the substantially linear segments 154 at cut crease line 158.

To form the blank 10 into a carton 164 (best seen in FIGS. 6 and 7), the first bottom panel section 26 and the second bottom panel section 34 are brought towards each other. The blank 10 is folded at fold lines 16, 20, 24, 28, 32, and 36. Each protruding segment 146 is brought into alignment with each receiving flap 112 with the second bottom panel section 34 overlapping the first bottom panel section 26. Each protruding segment 146 then may be inserted into the corresponding receiving flap 112, which folds toward the interior of the carton 164 along the arcuate perforated portion 124. Additionally, the substantially trapezoidal shaped flaps 130 may be directed toward the interior of the carton 164 and inserted into the substantially triangular openings 104. By doing so, a carton having two open ends is formed. If desired, the first bottom panel section and the second panel section may be glued together using an adhesive or other technique to strengthen the carton further. The terms "glue" and "glued" are intended to encompass any adhesive or manner or technique for adhering materials as are known to those of skill in the art. While use of the terms "glue" and "glued" are used herein, it will be understood that other methods of securing the various panels are contemplated hereby.

Figure 6:
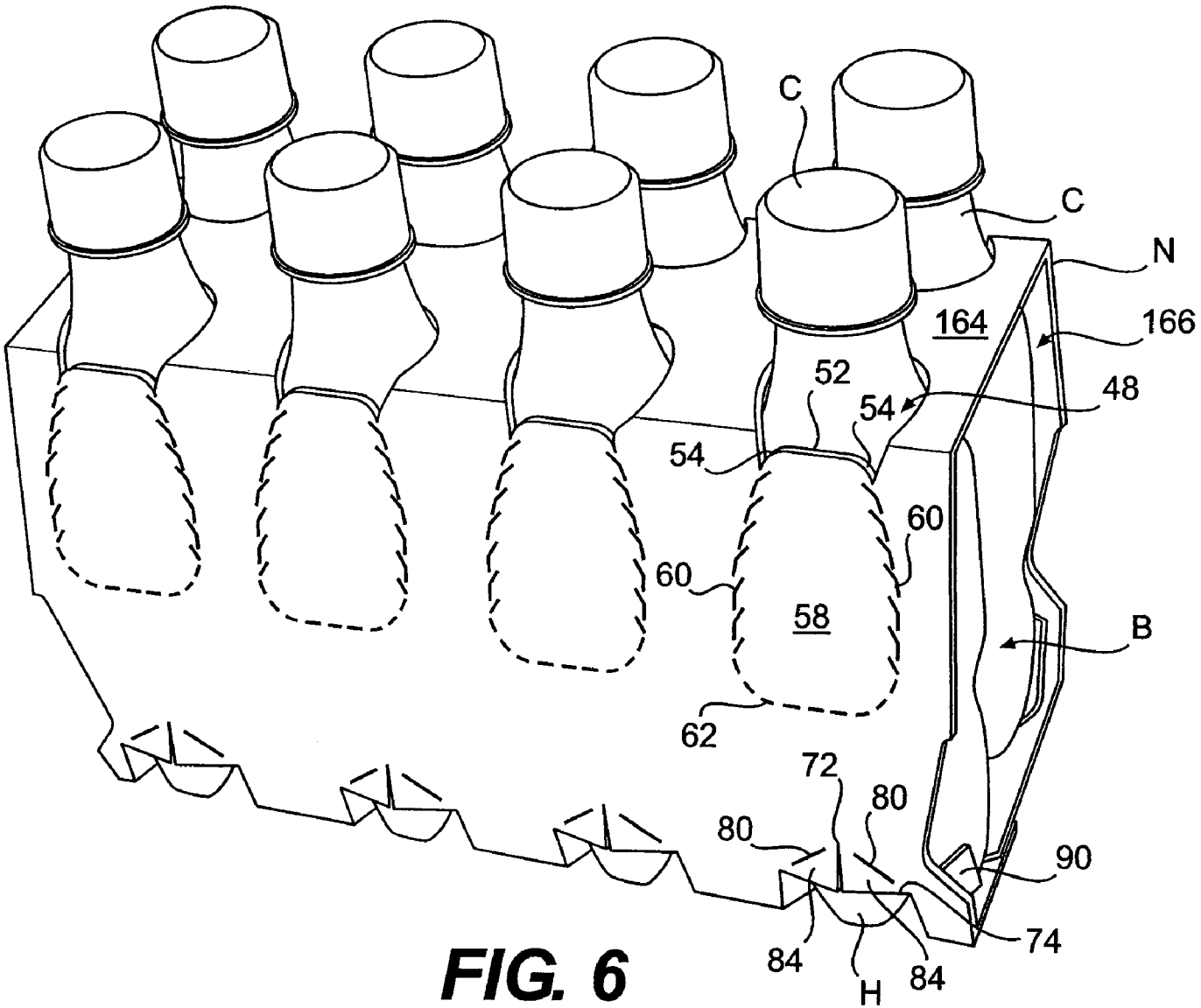
FIG. 6 is a perspective view of an exemplary carton formed according to the present invention.

FIG. 6 illustrates an exemplary carton formed according to the present invention. In this example, two rows or four containers C are held within the carton 164. Flaps 86, 88, and 90 are directed to the interior 166 of the carton 164, with the heel H of the base B of each container C resting against flaps 86 and on flaps 88 (see FIG. 8) and 90. It will be understood that other containers having a base without a heel may be used in accordance with the present invention. The neck N of each container C extends through the openings 48. The neck N of each container C typically is inserted into the each opening 48 prior to the blank 10 being wrapped around the containers C and formed into the carton 164.

Figure 7:
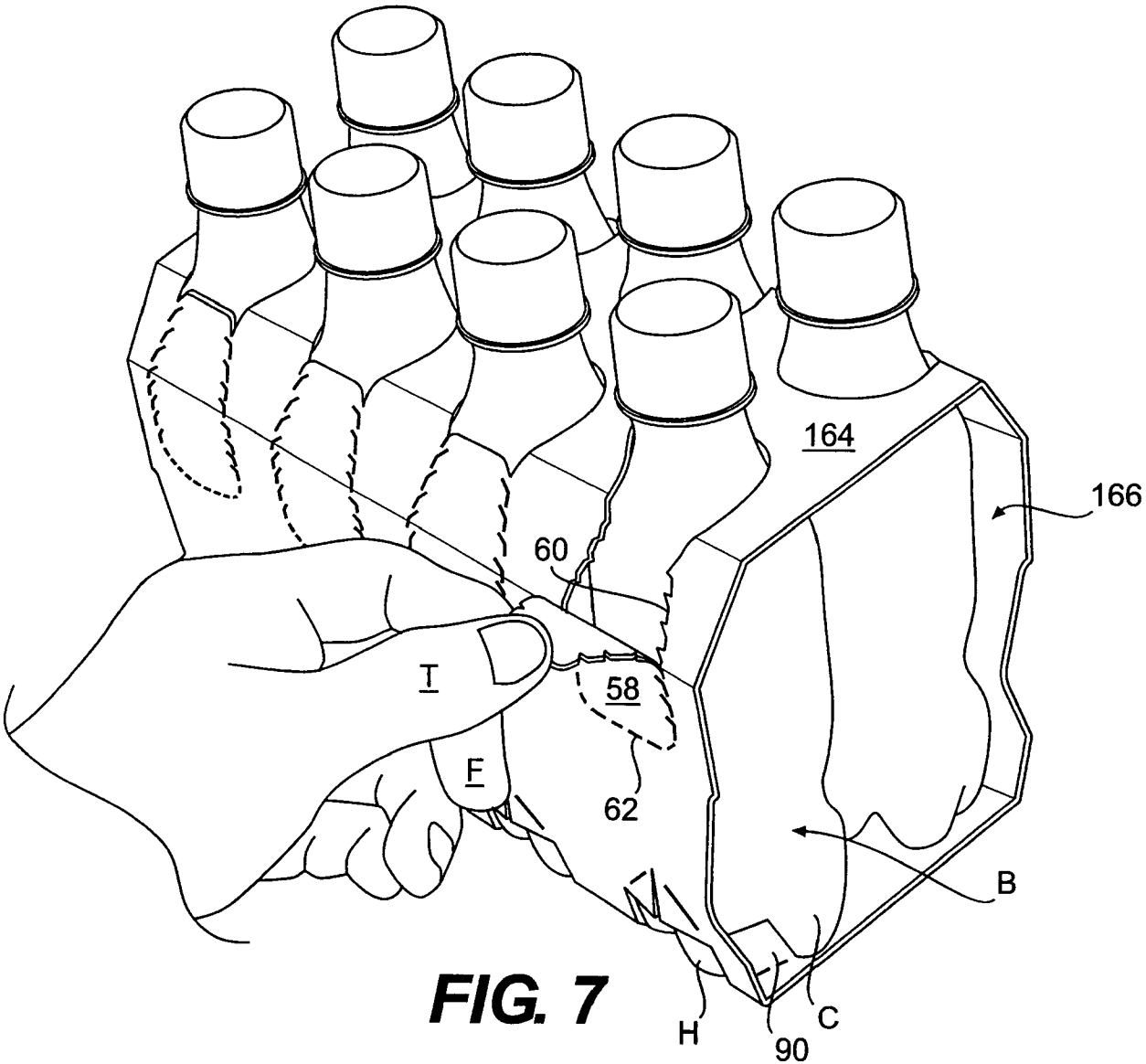
FIGS. 7 and 8 depict various perspective views of the carton of FIG. 6 illustrating removal of a bottle therefrom.

As illustrated in FIG. 7, a container C can be easily removed from the carton 164 by using the fingers F and the thumb T of a hand. To do so, a user grasps the tab 58 and pulls the tab away from the carton 164 along tear line 60 and optionally also along tear line 62. When the user has separated the tab 58 from the carton 164, the user may discard the removed tab 58 if desired. It will be understood that where line 62 is a fold line, the tab 58 is at least partially pulled away from the carton 164, and optionally folded along line 62.

Figure 8:
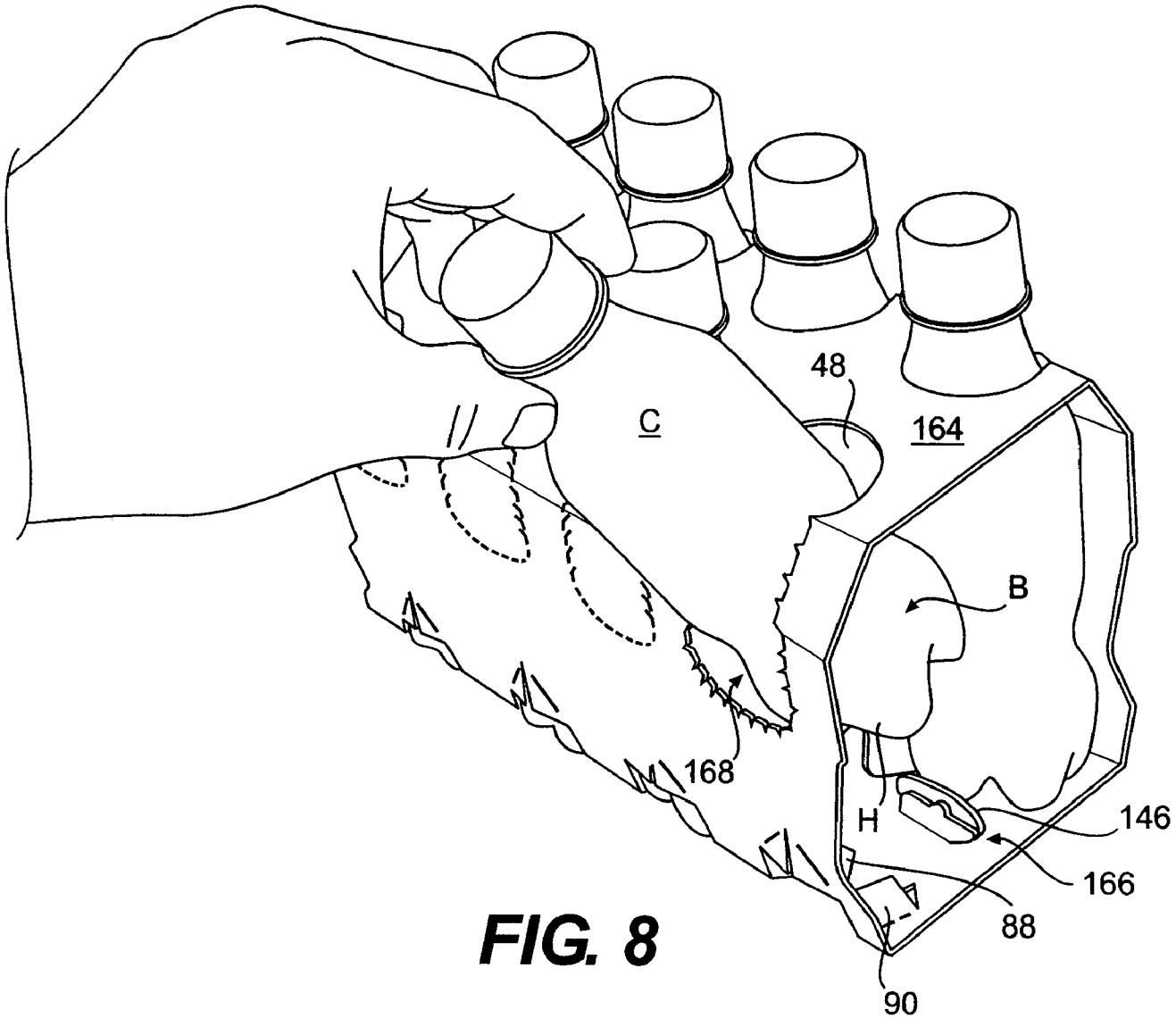

Turning to FIG. 8, once the tab 58 is removed the user may grasp the container C to be removed and pull the container C through an enlarged opening 168 formed by removing the tab 58 (not shown) adjacent the opening 48. In this manner, each container may be removed individually while the remaining containers continue to be secured within the carton. Thus, unlike other cartons, the containers may be removed without tearing the carton apart or otherwise destroying the carton.

It will be understood that the exemplary cartons shown herein may be used for cans or other types of cylindrical containers. Some of such cartons and dispensers may be particularly useful for PET bottles having a stubby configuration.

According to the various aspects of the present invention described herein or contemplated hereby, the blank and carton may be formed from a foldable sheet material. In one aspect, the blank is formed from paperboard. In another aspect, the blank may be formed from paperboard having a basis weight of at least about 100 pounds per ream. In another aspect, the blank may be formed from paperboard having a thickness of at least about 0.012 inches. The blank, and thus the carton formed therefrom, also may be constructed from other materials, for example, cardboard or any other suitable material. In the exemplary embodiments discussed above, the blanks are formed from coated solid unbleached sulfate (SUS) board. In general, the SUS board may have a caliper in the range of from about 18 to about 30, for example, 26. If needed or desired, the blank may be laminated to or coated with one or more different or similar sheet-like materials at selected panels or panel sections.

Optionally, one or more panels of the blanks and cartons discussed herein may be coated with varnish, clay, or other materials, either alone or in combination. The coating may then be printed over with product, advertising, and other information or images. The blanks also may be coated to protect any information printed on the blank. The blanks may be coated with, for example, a moisture barrier layer, on either or both sides of the blanks.

It will be understood that in each of the various blanks and cartons described herein and contemplated hereby, a "fold line" can be any substantially linear, although not necessarily straight, form of weakening that facilitates folding therealong. More specifically, but not for the purpose of narrowing the scope of the present invention, a fold line may be a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features. Where cutting is used to create a fold line, the cutting typically will not be overly extensive in a manner that might cause a reasonable user to consider incorrectly the fold line to be a tear line.

For example, one type of conventional tear line is in the form of a series of cuts that extend completely through the material, with adjacent cuts being spaced apart slightly so that a nick (e.g., a small somewhat bridging-like piece of the material) is defined between the adjacent cuts for typically temporarily connecting the material across the tear line. The nicks are broken during tearing along the tear line. Such a tear line that includes nicks can also be referred to as a slit, since the nicks typically are a relatively small percentage of the subject line, and alternatively the nicks can be omitted from such a slit. As stated above, where cutting is used to provide a fold line, the cutting typically will not be overly extensive in a manner that might cause a reasonable user to consider incorrectly the fold line to be a tear line. Likewise, where nicks are present in a slit (e.g., tear line), typically the nicks will not be overly large or overly numerous in a manner that might cause a reasonable user to consider incorrectly the subject line to be a fold line.

Accordingly, it will be readily understood by those persons skilled in the art that, in view of the above detailed description of the invention, the present invention is susceptible of broad utility and application. Many adaptations of the present invention other than those herein described, as well as many variations, modifications, and equivalent arrangements will be apparent from or reasonably suggested by the present invention and the above detailed description thereof, without departing from the substance or scope of the present invention.

While the present invention is described herein in detail in relation to specific aspects, it is to be understood that this detailed description is only illustrative and exemplary of the present invention and is made merely for purposes of providing a full and enabling disclosure of the present invention. The detailed description set forth herein is not intended nor is to be construed to limit the present invention or otherwise to exclude any such other embodiments, adaptations, variations, modifications, and equivalent arrangements of the present invention.

What is claimed is:

1. A carton blank comprising:

a plurality of openings extending from a first panel to a second panel, the first panel and the second panel joined by a first fold line; and a plurality of at least partially removable tabs, wherein the plurality of openings and the plurality of at least partially removable tabs are equal in number, and wherein each of the at least partially removable tabs begins on the second panel at a corresponding one of the openings and ends on a third panel joined to the second panel by a second fold line.

2. The carton blank of claim 1, wherein each of the plurality of openings has a truncated teardrop shape.

3. The carton blank of claim 1, further comprising a first bottom panel section including a plurality of elongated receiving flaps and a plurality of substantially triangular shaped openings.

4. The carton blank of claim 3, further comprising a second bottom panel section including a plurality of substantially trapezoidal shaped flaps.

5. The carton blank of claim 3, further comprising a second bottom panel section having a major edge defined by a plurality of alternating recessed segments and protruding segments.

6. A carton blank comprising:

a plurality of upper panels joined by fold lines, at least one of the upper panels comprising (a) at least one opening, the at least one opening having a truncated teardrop shape, and (b) an at least partially removable tab extending from the at least one opening;

a side panel;

a bottom panel; and a plurality of slits and perforations extending from the side panel to the bottom panel, the plurality of slits and perforations comprising (a) a substantially linear first slit including a J-cut at each end thereof, (b) a lateral slit extending substantially perpendicularly from the first slit, and (c) a transverse slit substantially perpendicular to the lateral slit.

7. The carton blank of claim 6, further comprising:

a pair of opposed angular slits extending angularly away from each J-cut toward the transverse slit;

a pair of angular perforation lines extending between the angular slits toward the transverse slit;

a pair of slits extending between and spaced from the angular perforation lines and the lateral slit; and a plurality of perforation lines forming a generally diamond-shaped perforation pattern extending between the angular slits across the lateral slit.

8. The carton blank of claim 6, wherein the bottom panel comprises a first bottom panel section including a plurality of elongated receiving flaps and a plurality of substantially triangular shaped openings.

9. The carton blank of claim 8, wherein the bottom panel comprises a second bottom panel section including a plurality of substantially trapezoidal shaped flaps and a major edge defined by a plurality of alternating recessed segments and protruding segments.

10. A carton comprising:

a top panel including at least one opening capable of receiving a neck of a container;

an at least partially removable tab extending from the at least one opening, wherein the at least one opening and the at least partially removable tab are capable of forming an enlarged opening through which the container can be removed; and a bottom panel section joined to a side panel by a fold line, and a plurality of slits and perforations extending from the side panel to the bottom panel section, the plurality of slits and perforations comprising (a) a substantially linear slit including a J-cut at each end thereof, (b) a lateral slit extending substantially perpendicularly from about a midpoint of the slit, (c) a transverse slit substantially perpendicular to the lateral slit, (d) a pair of opposed angular slits extending angularly away from each J-cut toward the transverse slit, (e) a pair of angular perforation lines extending between the angular slits toward the transverse slit, and (f) a plurality of perforation lines forming a generally diamond-shaped perforation pattern extending between the angular slits across the lateral slit.

11. The carton of claim 10, wherein the at least one opening is substantially teardrop shaped, and wherein the at least one opening includes a truncated portion defined by a linear segment having a point at each end of the linear segment.

12. The carton of claim 10, further comprising a bottom panel formed from the first bottom panel section and a second bottom panel section, the first bottom panel section including a plurality of elongated receiving flaps and the second bottom panel section including a plurality of protruding segments engaged with the plurality of elongated receiving flaps.

13. The carton of claim 10, further comprising a bottom panel formed from the first bottom panel section and a second bottom panel section, the first bottom panel section including a plurality of substantially triangular shaped openings and the second bottom panel section including a plurality of substantially trapezoidal shaped flaps engaged with the plurality of substantially triangular shaped openings.

14. A carton for a plurality of containers, comprising:

a plurality of openings extending from a first panel to a second panel, the first panel and the second panel joined by a first fold line; and a plurality of at least partially removable tabs, wherein the plurality of at least partially removable tabs and the plurality of openings are equal in number, each of the plurality of at least partially removable tabs begins on the second panel at a corresponding one of the plurality of openings and ends on a third panel joined to the second panel by a second fold line, and the openings and the at least partially removable tabs are capable of forming enlarged openings through which the containers can be removed.

15. The carton of claim 14, wherein each of the plurality of openings is substantially teardrop shaped, and wherein each of the plurality of openings includes a truncated portion defined by a linear segment having a point at each end of the linear segment.

16. The carton of claim 14, further comprising a bottom panel formed from a first bottom panel section and a second bottom panel section, the first bottom panel section including a plurality of elongated receiving flaps and the second bottom panel section including a plurality of protruding segments engaged with the plurality of elongated receiving flaps.

17. The carton of claim 14, further comprising a bottom panel formed from a first bottom panel section and a second bottom panel section, the first bottom panel section including a plurality of substantially triangular shaped openings and the second bottom panel section including a plurality of substantially trapezoidal shaped flaps engaged with the plurality of substantially triangular shaped openings.

18. A method of providing access to a container contained within a carton, comprising:

(a) providing a carton comprising at least one opening and an at least partially removable tab extending from the at least one opening, wherein the at least one opening extends from a first panel to a second panel which is joined to the first panel by a first fold line, and wherein the at least partially removable tab begins on the second panel at the at least one opening and ends on a third panel which is joined to the second panel by a second fold line;

(b) providing a container within the carton, wherein a neck of the carton is received within the at least one opening;

(c) at least partially separating the at least partially removable tab from the carton to form an enlarged opening through which the container can be removed, wherein the step of at least partially separating the at least partially removable tab comprises at least partially separating the at least partially removable tab from the third panel after at least partially separating the at least partially removable tab from the second panel; and (d) removing the container from the carton by passing at least a base of the container through the enlarged opening.

19. A carton blank for being formed into a carton that at least partially contains a plurality of containers with necks, the blank comprising:

a plurality of panels that are respectively foldably connected to one another and includes a first panel, a second panel and a third panel, wherein the second panel is positioned between the first panel and the third panel;

a plurality of openings that are at least partially defined in the second panel for respectively receiving the necks of the containers, with all of the openings being spaced apart from one another;

a plurality of at least partially removable tabs that are adapted for respectively being at least partially torn away to respectively enlarge the openings, wherein a first group of the tabs are at least partially defined in the first panel and do not extend into the third panel, a second group of the tabs are at least partially defined in the third panel and do not extend into the first panel, and for each of the plurality of tabs, each tab is configured so that the tab is for use in enlarging only a respective single opening of the plurality of openings.

20. The carton blank according to claim 19, wherein for each of the at least some of the plurality of tabs:

each tab is at least partially defined by at least two tear lines, each of the two tear lines originates proximate the respective single opening that the tab is for use in enlarging, and the two tear lines extend away from the respective single opening, which the tab is for use in enlarging, in substantially a same direction.

21. The carton blank according to claim 20, wherein for each of the plurality of tabs, the two tear lines, which at least partially define each tab, extend divergently away from the respective single opening that the tab is for use in enlarging.

22. The carton blank according to claim 20, wherein for each of the plurality of tabs:

each tab is at least partially defined by an additional tear line, and the additional tear line extends between the two tear lines that originate proximate the respective single opening that the tab is for use in enlarging.

23. The carton blank according to claim 19 in combination with the plurality of containers, wherein the blank is at least partially wrapped around the plurality of containers, and the necks respectively extend through the plurality of openings.

* * * * *

UNITED STATES PATENT AND TRADEMARK OFFICE

CERTIFICATE OF CORRECTION

PATENT NO. : 7,374,038 B2
APPLICATION NO. : 11/196633
DATED : May 20, 2008
INVENTOR(S) : Smalley It is certified that error appears in the above-identified patent and that said Letters Patent is hereby corrected as shown below:

Title page, item (*) Notice: delete “221 days” insert --273 days--.

Signed and Sealed this

Ninth Day of June, 2009

JOHN DOLL
*Acting Director of the United States Patent and Trademark Office*